United States Patent [19]

Tuffal et al.

[11] Patent Number: 4,765,554

[45] Date of Patent: Aug. 23, 1988

[54] RELATING TO COMPRESSION TYPE ROLLING MACHINES

[75] Inventors: Guy Tuffal; Yves Audren, both of Orange, France

[73] Assignee: Isover Saint-Gobain, Courbevoie, France

[21] Appl. No.: 24,600

[22] Filed: Mar. 11, 1987

[30] Foreign Application Priority Data

Mar. 11, 1986 [FR] France ..... 86 03415

[51] Int. Cl.[4] ..... B65H 18/08

[52] U.S. Cl. ..... 242/55.1; 242/67.1 R; 242/DIG. 3

[58] Field of Search ..... 242/55, 55.1, 67.1 R, 242/65, 66, 75.1, DIG. 3

[56] References Cited

U.S. PATENT DOCUMENTS 4,583,697 4/1986 Bichot et al. ..... 242/DIG. 3

FOREIGN PATENT DOCUMENTS 3326701 2/1985 Fed. Rep. of Germany .
1136557 12/1968 United Kingdom .

*Primary Examiner*—David Werner
*Attorney, Agent, or Firm*—Oblon, Fisher, Spivak, McClelland & Maier

[57] ABSTRACT

In the packaging of products such as rolls of mineral wool felts, a series of members entrain the felt into a space in which the rolling-up takes place. At least one of these members is mobile in relation to the others in order to alter the size of the space in which the rolling-up takes place as the roll of felt increases in size. This movable member is a roller whose surface contracting the felt is covered with an inorganic coating resistant to abrasion and adapted to have a rough finish.

12 Claims, 2 Drawing Sheets

RELATING TO COMPRESSION TYPE ROLLING MACHINES

BACKGROUND OF THE INVENTION

1. Field of the Invention:

The invention relates to an apparatus for the packaging of products such as mineral wool felts.

2. Background of the Related Art:

A conventional way of packaging a felt strip consists of rolling the felt up onto itself and compressing it. Thus, cylindrical rolls are formed which are wrapped and held in by a sheet of paper or polymer material.

To form compressed felt rolls and wrap them with a sheet to form a unitary package, it is conventional practice to use a machine such as that which is the subject of U.S. Pat. No. 4,583,697 or other similar machines. In these machines, the felt is rolled up on itself within a defined space. In the case of the aforesaid Patent , this space is defined by two conveyor belts and a compression roller. In other machines, the confined space is constituted by a plurality of rollers. In all cases, the rollers and conveyors are caused to move so as to entrain the felt into the space which they bound while at the same time imparting a certain compression to the roll being formed.

Compression of the felt in the roll is provided during the regular rolling-up of each turn. In some way or another, it is essential to keep the strip of felt forming the roll properly tensioned throughtout the entire operation. Otherwise, even if the felt is kept compressed within the restricted space, the roll would tend to resume its volume once the compression was relaxed.

In order to keep the felt properly tensioned during each of these turns, it is necessary to precisely regulate the speeds of the elements defining the space in which the roll is formed and in particular that of the final roller with which the felt is in contact. It is this final roller which makes it possible to properly regulate the "tension" which is exerted on the felt while it is being compressed. Following contact with this roller, the conditions of rolling-up and of compression which result therefrom are no longer open to change. The position of the turns of the roll in relation to one another is finally established. For this reason, the peripheral speed of this roller is often maintained slightly higher than that of the other rollers or conveyors constituting the rolling or winding machine.

In the ensuing description, reference is made to a machine of the type comprising two conveyors and one compression roller for the part in which the felt is rolled up. The same considerations may apply to other machines, particularly to those which only comprise rollers.

When using these rolling-up machines, certain difficulties have been encountered in maintaining satisfactory conditions. The roll of formed felt does not, for example, exhibit the desired compression characteristics, its diameter may be greater than that envisaged or the rolling-up action is irregular, the end faces of the roll form cones, to mention only the main difficulties.

Such difficulties have an effect on the resulting packages. It is not possible to stack the rolls on end faces unless these are flat. Once the required dimensions have been exceeded, the completed bundles no longer have the right outline to be loaded on railway wagons or trailers.

Although it is possible, to a certain extent, to compensate for defective operation of the apparatus, at least with regard to the dimensions, such a correction is often achieved only to the detriment of the quality of the rolling-up operation. Indeed, U.S. Pat. No. 4,583,697 has stated the importance of the way in which the rolling-up is carried out, its effect on the qualities of the felt when it is used later on and that as far as possible the compression exerted over the entire length of the felt constituting the roll should be properly monitored. A poor rollingup, in compression with that which it is desired to achieve, ordinarily leads to a badly distributed compression (generally over compression at the outset) which adversely affects the felt's later resumption of thickness and hence its insulating properties.

SUMMARY OF THE INVENTION

From a study of the reasons for these malformations, it became apparent that they developed progressively during the course of operations and were linked to the condition of the compression roller.

As previously indicated, it is this roller which establishes the rolling-up conditions. This roller, which is of relatively small diameter to allow the original demarcation of a confined space of small dimensions, is in contact with the felt or a covering on the felt over a small surface area. It is therefore important that while this contact is being established, the roller should adhere suitably to the felt or to the covering thereon. It will be appreciated that in the absence of satisfactory adhesion, a certain slip will occur and the conditions necessary to obtain a satisfactory rolling will no longer exist.

To obtain a good adhesion of the compression roller on the felt, it is normal to use a roller covered with a material of a rubber or some other similar polymeric material which offers a good coefficient of friction. It is likewise customary to choose the surface area of this roller, or more precisely of the material which covers it, so that it has some texturing in order to further enhance adhesion.

The inventors have demonstrated that the origin of the difficulties referred to earlier was linked to the adhesion of this surface. It is not, as might seem logical, purely a question of "wear and tear" on the material. Indeed, dimensional changes in the covering of the compression roller, even if they were present, cannot explain the magnitude of the changes found in the way the apparatus functions.

The inventors have shown that these changes are linked to the alteration in the qualities of adhesion of the material constituting the contact surface of the compression roller. As it is used, the surface in question becomes increasingly smoother and harder and its adhesion, whether this be on a fibre felt or on a covering of the kraft paper type, is considerably reduced.

There are many reasons for the deterioration in the surface. First of all, it must be borne in mind that the friction of the roller on an abrasive material such as the fibres results in a "polishing" of the contact surface. Furthermore, even without direct contact with the fibres, the rubbing which might possibly take place against the covering of the felt warms up the material quite substantially, which causes it to age and to become progressively harder. It must also be borne in mind that the polymeric surface is from time to time accidentally in contact with products which encourage its degradation. This is the case particularly with glues for fixing the wrapping which holds the roller once it has been formed.

Whatever the reasons may be, the surface of the roller progressively loses its adhesion and in order to retain the desired characteristics in the finished roll, there is a tendency to increase the rotary speed of the roller. Nevertheless, beyond a certain threshold, this type of compensation does not make it possible to achieve satisfactory results, the more so since it only provides a remedy to faults in which the degradation likewise affects the entire width of the compression roller. When this degradation is not uniform, which for example results in conical ends, no compensation is possible. In the final analysis, the surface covering has to be replaced from time to time.

In practice, and as a function of the rate of use, the effective life of conventional rollers may be around 200 hours. Replacements are therefore relatively frequent and constricting since they involve a momentary interruption of production.

The aim of the invention is to achieve rolling apparatuses which offer a substantially longer period of use under the same working conditions.

The object of the invention is likewise to achieve this duration of use without any need to alter the parameters during operation in order to compensate for any progressive deterioration in the qualities of adhesion.

Attempts have been made with various synthetic coverings. The improvements obtained under these conditions are relatively limited, an improvement in the hardness of the material often being offset by reduced adherence.

The improvement sought was finally obtained by the inventors by disposing on the compression roller a mineral covering which forms a rough surface, this covering being disposed over at least a part of the surface of the roller and being of quite considerable hardness.

This type of covering used according to the invention must furthermore adhere in a very stable fashion to the substrate of the roller or to the elements connected to the surface of the roller.

Mineral coatings have the advantage of withstanding virtually without any change the temperatures imposed by the normal operating conditions, in contrast to the polymeric coatings of the prior art. The temperatures in question result from contact with the felt emerging from the binder processing oven. They also result from friction of the compression roller on the felt or its covering. In practice, under these conditions, the roller is raised to a temperature of between 100° and 200° C. these temperatures which are likely to produce rapid ageing of synthetic materials remain undamaged when the coverings according to the invention are used. In other words, the materials constituting the coverings according to the invention must withstand temperatures in excess of 200° C.

Indeed, the materials capable of satisfactorily meeting the other conditions, particularly of hardness, can without alteration withstand far higher temperatures. If need be, the rollers modified according to the invention could well make it possible to work under conditions which would have been rejected out of hand within the context of the prior art.

Coating materials capable of offering good resistance to abrasion are well known. There are, for example, oxides such as corundum, carbides such as tungsten, molybdenum or silicon carbides, the nitrides of the same metals or generally any materials known for their resistance to abrasion.

The materials chosen are also such that they can be fixed on the compression roller by traditional techniques such as metallization by electrical discharge, a technique referred to as the "schoop process". Possibly, for materials which might not be sufficiently stable when fixed on the steel roller by deposition, it might be possible to combine formation of the hard abrasion-resistant coating with that of some other material serving as a support matrix, particularly a metal which itself offers good mechanical strength such as molybdenum.

So that the coating material can have a good coefficient of friction, it is disposed in non-uniform fashion over the surface of the roller. A preferred method resides in forming a granular coating in which the grains are of dimensions which favor friction with the felt or its covering in contact with the compression roller. The dimensions of the grains obtained by metallizing techniques, which are ordinarily around a millimeter or a few tenths of a millimeter, are quite suitable for the application according to the invention, particularly when the surface in contact with the roller is relatively smooth and not easily deformable.

For certain products, gripping may also be improved at the periphery of the compression roller. To the extent that a metallization technique is used to form the grains which provide the friction coefficient, it is difficult for the elements of roughness to exceed about 1 mm. To go beyond this limit, it is according to the invention possible to provide texturing of the roller periphery which may take various forms: furrows, grooves, studs or other forms which are covered with roughening material having a finer granulation which, in this case, over and above enhancing the friction, is aimed at protecting these texturing shapes from excessingly rapid wear.

Even if protected by the coating, the peripheral texturing is subjected to not inconsiderable wear and tear. In order not to have to replace the whole roller, it is preferable to use attached elements to constitute this texturing. According to the invention, it is possible in particular to regularly dispose on the periphery of the roller bars or rods which project beyond the surface of the roller. The bars or rods (or equivalent elements) are provided with a coating of abrasion-resistant material which can be replaced when prolonged use reduces their friction properties.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
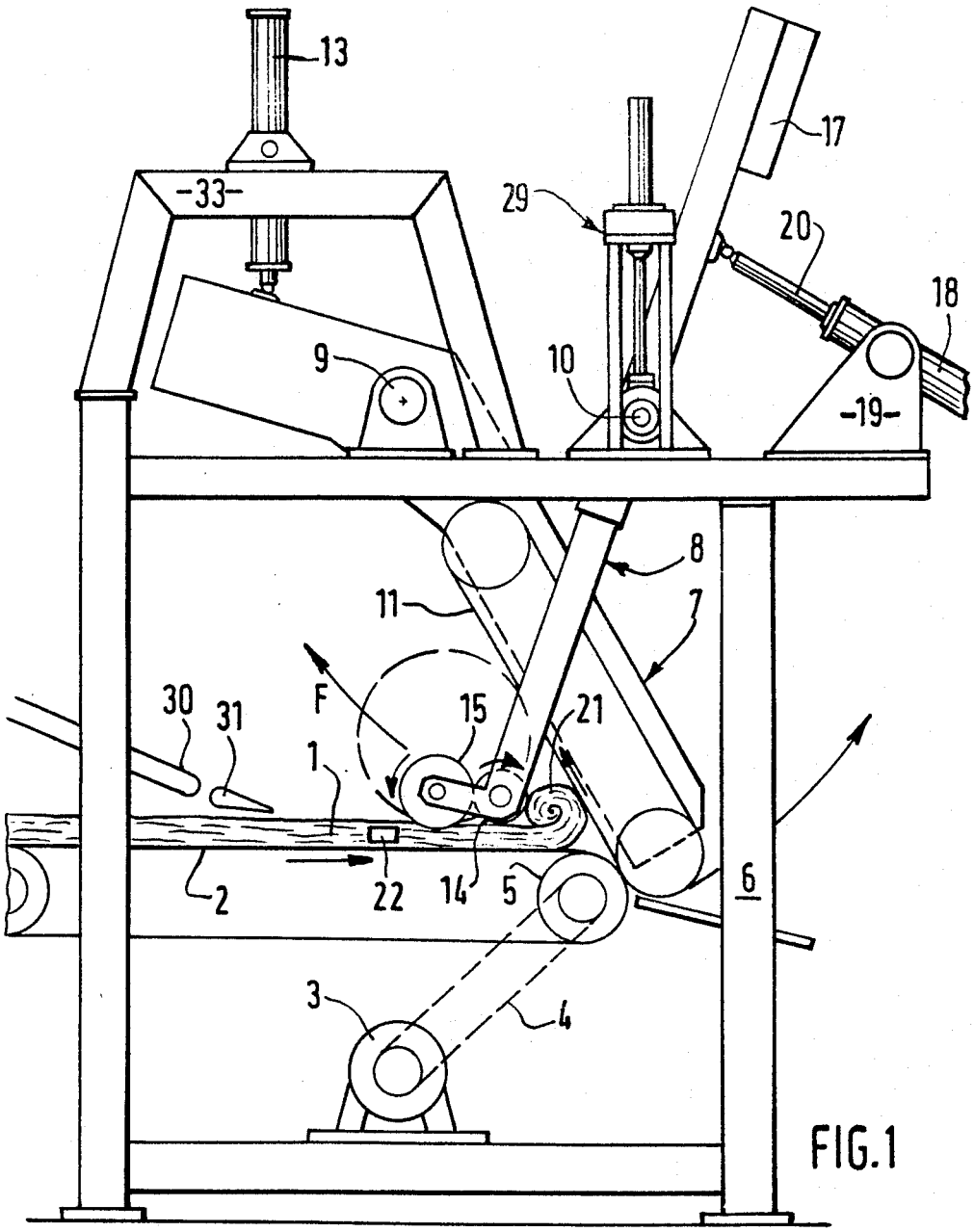
FIG. 1 is a diagrammatic view of a rolling machine such as that used according to the invention.

The rolling machine shown in FIG. 1 may be used for forming rolls of glass wool felt or of similar compressible products.

This rolling machine may be disposed directly at the end of a line producing strips of these felts. The manner in which the fibres are produced is umimportant to the invention. It is sufficient that the felt constituted by means of these fibres is of good resilience, in other words it must be capable of withstanding considerable compression and afterwards regaining the major part of its initial thickness when it is no longer compressed.

It goes without saying that among the mineral felts, only those which are described as "light" lend themselves to this type of packaging. For volumetric masses exceeding 30 kg/cu.m and thicknesses exceeding 20 mm, even if the packaging includes a certain compression, such compression can only be exerted on flat products. In the same way, felts covered on at least one of their surfaces can be rolled up only on the condition that the covering is capable of undergoing considerable flexion without damage. This is the case particularly with kraft papers, coverings consisting of films of polymeric materials, aluminized or not, and generally any thin and flexible coverings.

The felt 1 progresses along the conveyor 2 in the direction indicated by the arrow. The conveyor 2 is propelled by the motor 3 through a belt 4 and a driving drum 5.

A frame 6 straddling the conveyor 2 supports two arms 7 and 8. These arms are adapted to rotate respectively about spindles 9 and 10 carried by bearings fixed on the frame 6.

The arm 7 carries a dorsal conveyor 11 of which the end which is more remote from the spindle 9 is situated in opposition to, and at a short distance from, the end of the conveyor 2. This distance should be as small as possible. The object of this arrangement is to facilitate starting of the roll by allowing a minimum of space to the felt. This distance must, however, be sufficient to avoid any risk of the conveyors rubbing on each other.

The faces of the conveyors subtend an angle which is less than 90°. This angle is advantageously between 40° and 80° and is preferably close to 60°.

The conveyor 11 is propelled by the motor 3 through a deformable and articulated transmission, not shown. This articulated transmission is such that it allows the arm 7 to tilt in the manner described below.

A jack 13 fixed on a support 33 rigid with the frame 6 makes it possible to tilt the arm 7 about spindle 9 in such a way as to move the end of the conveyor 11 away from that of the conveyor 2. In the remote position, the distance separating the two conveyors is greater than the diameter of the rolls of felt formed, so that the latter can be removed.

The fluid supply to, and controls for, the jack 13 are not shown.

The arm 8 comprises two identical parts situated one on either side of the arm 7, which they frame. The bottom ends of the two parts of the arm 8 carry two rollers 14 and 15. These rollers are caused to rotate by chains, not shown, which are situated along the arm itself. The drive is provided by the motor 3 through a flexible are articulated transmission which is not shown. The chains each extend between pulleys, one of which is coaxial with the axis of rotation 10 of the arm 8 so that a movement of the arm 8 can be carried out without changing the chain tension. A speed varying device, not shown, is incorporated into the chain transmission system.

The arm 8 is extending by a counter-weight 17 which balances it and which facilitates its movement.

In this preferred embodiment of the invention, the space in which the strip of felt is rolled up is bounded by two conveyors 2 and 11 and by the roller 14. If necessary, at least one of the two conveyors may be replaced by a roller which fulfills the same function. Despite a somewhat more complicated mechanism, the use of conveyors is advantageous for several reasons.

The first reason is that even if the rollers are of relatively large dimensions, the contact with the rolled up strip takes place over a convex surface which tends to deform the surface more than would a conveyor which has a flat surface. This is important to the satisfactory formation of the roll.

It should be noted in passing that the use of large diameter rollers has the disadvantage of resulting in a rolling-up space which is relatively large in the position corresponding to the commencement of the operation, which does not allow an entirely satisfactory control over the conditions imposed throughout the rolling-up process.

Another reason is that, when using rollers instead of one or both conveyors, the relative positions of the rollers being fixed, the bearing points of the rolled up felt evolve as a function of the progress of the rolling operation. Adopting the premise of an arrangement where the three bearing points are initially regularly distributed over the circumference of the felt roll, this regularity disappears during a rolling operation very quickly and maintaining it is less readily assured.

It is possible to change the position not only of the roller 14 (the compression roller), but also all the rollers (or conveyors) in relation to one another so that the bearing points remain properly distributed, without necessitating a complicated mechanism.

It therefore seems preferable to use conveyors whose relative positions may remain fixed. The increase in the diameter of the roll of felt is accompanied by a displacement of the bearing points on the conveyors, displacements which tend to restore a balanced disposition of these bearing points.

The third bearing point, which is on the compression roller, is likewise displaced according to a movement which maintains this satisfactory disposition. Diagrammatically, in this ideal dispostion, the bearing points are equidistant from one another. In order to come close to this arrangement, the distance of the compression roller 14 from the axis of rotation is sufficiently great and the position of this axis is preferably such that displacement takes place substantially according to the bisectrix of the angle of the two conveyors.

An air operated jack 18 mounted on a support 19 rigid with the frame 6 makes it possible to move the arm 8, via its rod 20.

According to the aforesaid U.S. patent, movement of the arm and hence the pressure exerted on the felt follow a pre-established program. For this, the position of the arm corresponding to arm 8 is precisely defined at every moment. An air operated jack fulfills a passive function as a pneumatic spring in the known structure. When the arm, pushed back by the rolled up felt, pivots about the spindle 10, the pressure of the air in the jack increases and by reaction the pressure on the felt is increased.

In the embodiment illustrated, however, the drive jack 18 is a positively controlled jack. Its power is chosen to be sufficiently high that the pressure exerted by the felt has virtually no effect on the functioning of the compression roller 14. The movement of the arm 8 is dependent upon the length of rolled up felt.

The rolling machine also comprises means by which it is possible at any moment to determine the length of the rolled up felt.

Means which also make it possible to modify the initial height of the spindle 10 of the arm 8 are shown at 29 and may, for example, be a nut and screw system driven by a motor.

The rolling machine functions in the following way.

Carried by the conveyor 2, the strip of felt 1 passes in front of the photoelectric cell 22 and triggers a measurement of the time elapsing in the operating cycle.

Before penetrating the space defined for the rolling process, the strip of felt is compressed by means of the roller 15.

The roller 15 is carried by the arm 8. Like the compression roller 14, it is driven by the chain drive but turns in the opposite direction to the roller 14. The roller 15 makes it possible to avoid the felt coming in contact with the roller 14 when it is introduced into the space in which the rolling takes place since the direction of rotation of the roller 14 is such that it would tend to repel the felt instead of facilitating its entrance into this space.

The rotary speed of the roller 15 is regulated so that the speed at its periphery substantially corresponds to that of the conveyor 2.

The felt carried on the conveyor 2 encounters the dorsal conveyor 11 and folds or rolls back on itself due to the upward movement of the conveyor belt. From the conveyor 11, the end of the felt moves towards the compression roller 14. The rotation of the roller 14 constrains the felt to bend over again onto itself. Due to the roller 14, the end of the felt is returned towards the conveyor 2 whence it comes in contact with the upper surface of the felt.

A first loop of felt is thus formed. In a similar manner, the roll then forms successive thicknesses which are added to one another.

Very soon after the rolling process starts, the compression roller 14 moves away from its initial position to allow for the increase in the volume of rolled up felt. The displacement takes place in the direction indicated by the arrow F, by tilting of the arm 8 via jack 18.

As it moves away from its initial position, the arm 8 progressively increases the distance between the conveyor 2 and the roller 15. This distance becomes such that from a certain moment onwards the roller 15 ceases to be in contact with the felt. However, the distance is then also sufficient that the felt carried by the conveyor 2 does not come in contact with the compression roller 14.

At the end of the strip of felt 1, a wrapping of paper or polymer is deposited on one of the faces of the felt. The length of this wrapping is such that it covers the whole outer surface of the rollin a known manner.

During this time, the roll having attained its final dimensions (dashed line), displacement of the arm 8 ceases.

The wrapper having been placed on the felt, packaging of the strip of felt is completed, for example by gluing of the wrapper in such a way that the latter maintains the felt in its final compressed form. The arm 7 is moved by the jack 13 and tilts so that the roll of felt which is moved by the conveyor 2 is discharged through the aperture provided between the conveyors 2 and 11.

At the same time, the arm 8 is returned to its initial position. Finally, the arm 7 is likewise returned to its working position. The rolling machine is ready to handle a fresh strip of felt.

The tilting movements of the arm 7 and the return movement of the arm 8 are performed very rapidly so that the lapse of time between the rolling of two strips of felt can be very short.

In these operations, the compressed felt does not exhibit a strictly cylindrical form. It suffers a slight crushing at the points of contact with the conveyors and the compression roller. The use of conveyors 2 and 11 makes it possible to maintain a relatively wide contact surface with the felt, particularly in comparison with that of the compression roller 14. This latter must necessarily have a small radius of curvature in order to be able to define a rolling-up space which is of small dimensions at the start of the process.

To minimise deformations of the roll of felt during its preparation, it may be advantageous to establish slight differences in speed between the conveyor 2 on the one hand and the conveyor 11 and the roller 14 on the other. By having the speed of the conveyor 11 and of the roller 14 slightly higher (generally less than 5%) than that of the conveyor 2, the felt is maintained under tension between these successive points of contact, so avoiding the apppearance of substantial deformations which might adversely affect the regularity of the rolling operation.

These slight differences in speed, if employed, permit compensation of any slip of the felt on the conveyor 11 or again on the roller 14, such a slip being possible due, for instance, to the small area of contact.

The system for introducing the wrapping is shown diagrammatically in FIG. 1. The cut and partially glued sheets emanate from a distributor, not shown, and are controlled by computing means while being transported on a conveyor belt 30. They pass over belts 31 in known manner, so that they are deposited on the end of the upper face of the felt strip at the moment when it is about to enter the rolling-up space. The sheet of wrapping is thus entrained by the felt.

The smoother the sheet used for the wrapping, the better must be the friction coefficient of the compression roller 14. Even if the felt is not wrapped or covered, the end of the rolling operation always includes contact between the roll 14 and this wrapping. Even at this stage of packaging. it is preferable to maintain the roll nicely "taut", which may be obtained, as we have indicated beforehand, by ensuring satisfactory gripping by the roller 14.

Preferably, rolling of the felt requires a surface exhibiting not only rough texturing for the roller 14 but also more accentuated relief elements.

Figure 2:
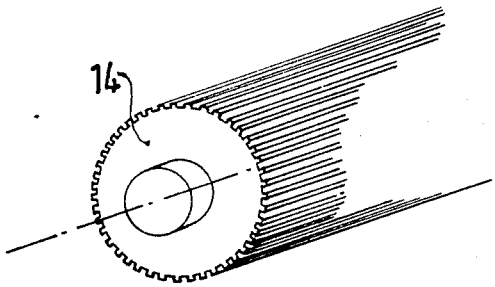
FIG. 2 shows in diagrammatic perspective an embodiment of a compression roller according to the invention.
Figure 3:
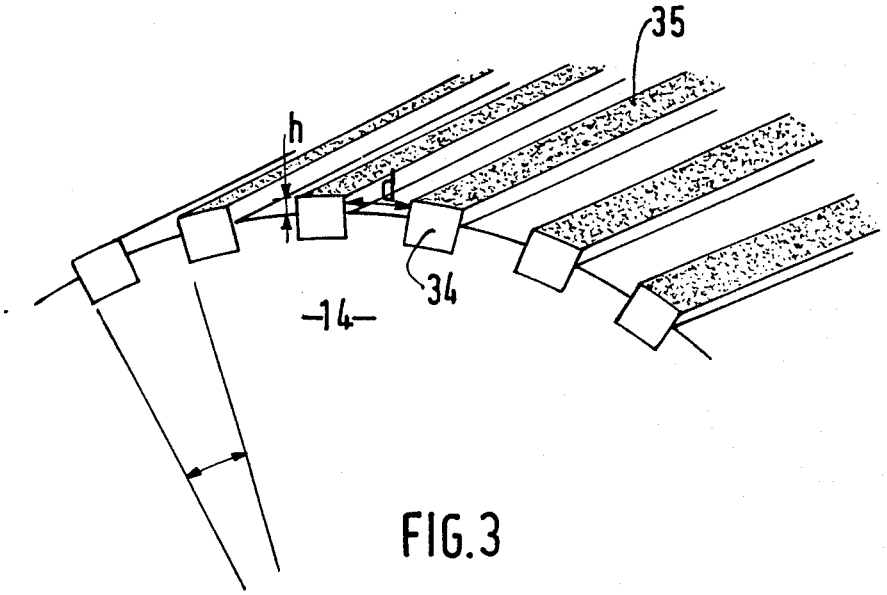
FIG. 3 is a section through a part of the roller in FIG. 2 showing the disposition of the bars over its periphery.

The embodiment shown in FIGS. 2 and 3 is intended particularly to resolve this difficulty. In this embodiment, the roller 14 has on its periphery and in a regularly spaced arrangement a series of longitudinal grooves disposed along its periphery. Inserted into each of the grooves is a bar 34 which matches the dimension of the groove. The dimensions of the bar 34 are such that it projects beyond the periphery of the roller. The bars as a whole determine the relief elements, the depth of which is adjustable by choosing bars of appropriate cross-section. These elements penetrate the compressible felt material and ensure that it is properly gripped.

Like the surface of the roller when this latter comes in direct contact with the felt or the covering thereon, these bars 34 are subject to quite marked abrasion. Unless particular precautions are taken, very rapid polishing of the surface is observed with a rapid loss of adhesion, particularly when the compression roller thus constituted is in contact with a smooth sheet.

To avoid this polishing, and in order to improve adhesion on the covering materials, at least the upper face 35 of the bars 34 is protected by a deposition of abrasion resistant material.

If necessary, the same deposition may be effected on the lateral faces of the bars and also on the projecting faces which are defined on the roller 14 by the grooves.

The optimum configuration of the periphery of the roller, particularly the number of bars, their spacing and their height above the surface of the roller, is determined by simple tests which can be carried out for each type of felt or covered felt in question. Considering the nature of these products, the height h of the relief element constituted by the bars is preferably no greater than the space d separating two successive bars. It is advantageous for this latter not to be greater than 20 mm and preferably to be less than 15 mm.

The relief element is advantageously between 3 and 10 mm long, including the height corresponding to the grains of abrasion resistant material deposited on the upper face 35.

By way of example, different tests were conducted under the same conditions for the treated felt, except that the compression rollers were changed. These tests involved rolling up a glass fiber felt of which the nominal thickness (that is to say the guaranteed thickness at time of use and after the packaging had been removed) is 90 mm, the strip being 9 m long and 1.20 m wide. The diameter of the finished roll is established at 400 mm.

In a first series of tests, the felt was not covered and the roll was wrapped in a sheet of kraft paper.

A conventional roller was represented by a compression roller covered with a sheet of polyvinyl chloride. The surface of the coating had regular grooves and the distance between any two crests was 6 mm and the depth 4 mm. These grooves were furthermore in broken lines forming a system of multiple herring bones along the periphery of the roller.

Using this conventional system, forming rolls of 500 mm diameter and not 400 mm, satisfactory operation of the roller was ordinarily not possible beyond 150 hours of use. During the course of this operating time, in order to offset a partial loss of adhesion, it was even necessary to moderately to increase the rotary speed of the compression roller.

When, for comparison with the results obtained by using the compression roller according to the invention, felt rolls of 400 mm diameter were formed by the conventional roller, the coating was subjected to far greater stresses. It was necessary to impose a systematic increase in speed and the deterioration occured far more rapidly. Under these conditions, the period of use could not ordinarily exceed 24 hours.

A compression roller of the same diameter (180 mm in the largest dimension), but formed according to the invention, made it possible to quite substantially prolong the effective operating life.

The roller tested was of the type shown in FIG. 3. It had 30 bars 34 of which the width of the exposed face 35 was 8 mm. They formed a relief element having a height h in excess of 5 mm and were housed in grooves 5 mm deep. They were held on the roller by screws, which made it possible for them to be replaced.

The exposed face was coated by the schoop process (metallization by a gun) using molybdenum and corundum, forming grains of a thickness not exceeding 1 mm. The deposition of molybdenum was constituted at the rate of 4 kg/sq.m and that of corundum at 12 kg/sq.m.

With this roller, operation was perfectly satisfactory over a period of more than three weeks, in other words approx. 500 hours, for the formation of rolls of felt with a diameter of 400 mm.

The same experiment was carried out with a smooth roller uniformly covered with the molybdenum/corundum deposit over its entire surface. A similar result was observed. An advantage of using the roller carrying the bars is that it lends itself to extremely convenient replacement using spare bars which can easily be made available from stock.

Operation of the compression roller with felts covered with kraft paper likewise produced satisfactory results.

The same tests were conducted with other abrasion resistant materials, particularly tungsten carbides. There, too, the results have been perfectly satisfactory in comparison with those obtained with conventional rollers.

Indendently of the long surface life when the operating conditions are ideal, using compression rollers which offer the characteristic features of the invention has the advantage that they are virtually insensitive to accidents which occur from time to time along the production line, such as for example jamming when for one reason or another the formation of the roll of felt has not got off to a good start. With conventional apparatus, such incidents lead to immediate deterioration of the friction coating. The coatings according to the invention easily withstand the effects of this type of incident.

Another advantage of the apparatuses according to the invention is that throughout their entire functioning period they turn out products the characteristics of which are completely stable over a period of time. In this way, when the initial adjustments have been carried out, it is possible for all the parameters to be kept constant, in contrast to previous experience.

As indicated above, it was conventionally necessary, as the operation proceeded and to allow for the deterioration in the compression roller, to vary the rolling-up speeds in order to maintain the characteristics of the formed rolls, at the risk of further accelerating the deterioration of the coating on the compression roller. This is not necessary according to the invention.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the Unites States is:

1. An apparatus for forming strips of mineral fibers into compressed fiber rolls, comprising:

a plurality of members defining a space in which the strip is rolled;

means for rolling said strip to form a roll;

means for moving at least one of said members in relation to others of said members in such a manner that said space is altered in accordance with a size of a roll being formed, wherein said at least one of said members each comprises a roller having a felt contacting surface in the form of regularly disposed relief elements; and an abrasion resistant inorganic coating on at least a portion of said felt contacting surface of said roller.

2. Apparatus according to claim 1 in which the abrasion-resistant inorganic coating comprises one of the compounds of the group consisting of carbides of molybdenum, nitrides of molybdenum, tungsten and silicon.

3. Apparatus according to claim 2 in which the inorganic coating comprises grains deposited by a schoop process.

4. Apparatus according to claim 3 in which the grains form elements having dimensions which are less than 1 mm.

5. Apparatus according to claim 3 wherein said abrasion-resistant inorganic coating includes a metallic coating forming a support for the said grains.

6. Apparatus according to claim 5 wherein said metallic coating comprises a layer deposited by said schoop process.

7. Apparatus according to claim 1 wherein said relief elements project from said roller by at least 2 mm.

8. Apparatus according to claim 7 wherein said relief elements are separated by regular widths of no more than 20 mm and project from said roller by between 3 and 10 mm.

9. Apparatus according to claim 8 wherein said relief elements are formed by removable bars fixed to said roller.

10. Apparatus according to claim 9 wherein said portion of said felt contacting surface having said coating comprises upper faces of said bars.

11. Apparatus according to claim 7 wherein said relief elements are formed by removable bars fixed to said roller.

12. Apparatus according to claim 11 wherein said portion of said felt contacting surface having said coating comprises upper faces of said bars.

* * * * *